United States Patent [19]

Yuasa

[11] Patent Number: 4,867,711

[45] Date of Patent: Sep. 19, 1989

[54] CONNECTOR WITH DOUBLE LOCK

[75] Inventor: Katsuhiko Yuasa, Ageo, Japan

[73] Assignee: AMP Incorporated, Harrisburg, Pa.

[21] Appl. No.: 286,926

[22] Filed: Dec. 20, 1988

[30] Foreign Application Priority Data

Jan. 31, 1988 [JP] Japan ..... 63-21105

[51] Int. Cl.[4] ..... H01R 13/426

[52] U.S. Cl. ..... 439/752; 439/744

[58] Field of Search ..... 439/599, 603, 742, 746, 439/752, 871–873

[56] References Cited

U.S. PATENT DOCUMENTS

| | | | |
|---|---|---|---|
| 3,328,745 | 6/1967 | Paullus . | |
| 3,573,720 | 4/1971 | Reynolds . | |
| 3,648,213 | 3/1972 | Kobler . | |
| 3,941,444 | 3/1976 | Bruni et al. . | |
| 3,971,613 | 7/1976 | Kobler . | |
| 3,982,805 | 9/1976 | Irie . | |
| 4,013,331 | 3/1977 | Kobler . | |
| 4,082,400 | 4/1978 | Gansert | 439/744 X |
| 4,284,320 | 8/1981 | Nix et al. . | |
| 4,583,805 | 4/1986 | Mantlik | 439/744 |
| 4,711,508 | 12/1987 | Sueyoshi | 439/603 X |
| 4,758,183 | 7/1988 | Aoyama . | |

FOREIGN PATENT DOCUMENTS 1912825 3/1969 Fed. Rep. of Germany ..... 439/752

*Primary Examiner*—Eugene F. Desmond

*Attorney, Agent, or Firm*—Adrian J. LaRue; Bruce J. Wolstoncroft

[57] ABSTRACT

An electrical connector comprises a dielectric housing (1) having contact-receiving passageways (2) in which electrical contacts (22) are secured by primary latch members (23) and a secondary latch member (14) is movably mounted at a rear surface of the housing (1) between said walls (3). Flexible retaining members (8) as part of the side walls (3) have ratchet teeth (8*a*) that engage ratchet teeth (17) in the sides of the latch member (14) to retain the latch member (14) at a contact-insertion position so that the contacts (22) can inserted through holes (15) of the latch member (14) into the passageways (2) and the latch member (14) is moved to a contact-latching position and retained there by the ratchet teeth (8*a*, 17) of the retaining members (8) and the latch member (14). Interengaging sections (4, 6; 11,20) of the housing (1) and the latch member (14) move the latch member (14) inwardly as it is moved from the contact-insertion position to the contact-latching position.

7 Claims, 4 Drawing Sheets

(A)

(B)

CONNECTOR WITH DOUBLE LOCK

FIELD OF THE INVENTION

This invention relates to an electrical connector having double-lock or double-latch members and more particularly to an electrical connector having a primary latch member located in a passageway of a housing as an integral part of the housing for latching engagement with an electrical contact when it is positioned in the passageway and a secondary latch member located at a back end of the housing as a separate member that is movably positioned to a latching position so that the latch members prevent removal of the contact from the housing.

BACKGROUND OF THE INVENTION

Electrical connectors having double-latch members are known and they are generally used in automobiles. In one of these connectors as disclosed in Japanese U. M. Publication No. 61-153975, a secondary latch member is hingedly connected to the housing and has latching projections that engage the electrical contacts in the passageways when the latch member is in a closed and latched position. The hinged-type secondary latch member presents a number of problems. One problem is that the hinge mounting the secondary latch member to the housing is deficient. Another problem is that the latch for latching the hinged secondary latch member in position on the housing is unreliable. A further problem is that the number of contacts that can be secured in the housing is very limited.

Another of these connectors is disclosed in Japanese U. M. Publication No. 57-192076 wherein the housing has a long area along which a separate secondary latch member is disposed for engagement with a section of the electrical contacts in the housing after they have been placed therein and the secondary latch member is itself latchably secured to the housing. The drawbacks of this connector are that the secondary latch member is a separate member susceptible to being lost; if the wires terminated to the contacts become crooked and tangled, positioning of the separate secondary latch member in the housing can be difficult; the secondary latch member can also be improperly positioned in the housing; and the number of contacts that can be secured in the housing is limited thereby resulting in less density.

SUMMARY OF THE INVENTION

The object of the present invention is to provide a double-lock or double-latch electrical connector that eliminates the above-mentioned problems of the known double-latch connectors.

The connector, according to the invention, includes a housing having a plurality of contact-receiving passageways in which electrical contacts are inserted and retained by primary latch members, each limiting the movement of the contact, and a secondary latch member in the form of a plate having holes which are arranged such that they are in alignment with housing passageways, the plate being slidably inserted between side walls at the rear of the housing and being movable from a contact-insertion position to a contact-latching position. Retaining members of the housing and the plate retain the plate in the contact-insertion position and the contact-latching position.

An electrical connector according to the present invention comprises a dielectric housing having contact-receiving passageways in which electrical contacts are secured by primary latch members, and a secondary latch member that is movably mounted at a rear surface of the housing between side walls thereof. Flexible retaining members as part of the side walls have ratchet teeth that engage ratchet teeth in the sides of the secondary latch member to retain it at a contact-insertion position so that the contacts can be inserted through holes of the secondary latch member into the passageways and the secondary latch member is moved to a contact-latching position and retained there by the ratchet teeth of the retaining members and the secondary latch member. Interengaging sections of the housing and the secondary latch member move the secondary latch member inwardly as it is moved from the contact-insertion position to the contact-latching position.

The interengaging sections comprise grooves on inside surfaces of the housing side walls which extend into narrow bottom sections with projections on the secondary latch member being disposed in and movable along the grooves and narrow bottom sections, and projections at the bottom of the side walls that are disposed in recesses at the bottom of the secondary latch member.

BRIEF DESCRIPTION OF THE DRAWINGS

The invention, together with the objects and advantages thereof, is described by way of example with reference to the following detailed description in conjunction with the accompanying drawings.

DETAILED DESCRIPTION OF THE INVENTION

Figure 1:
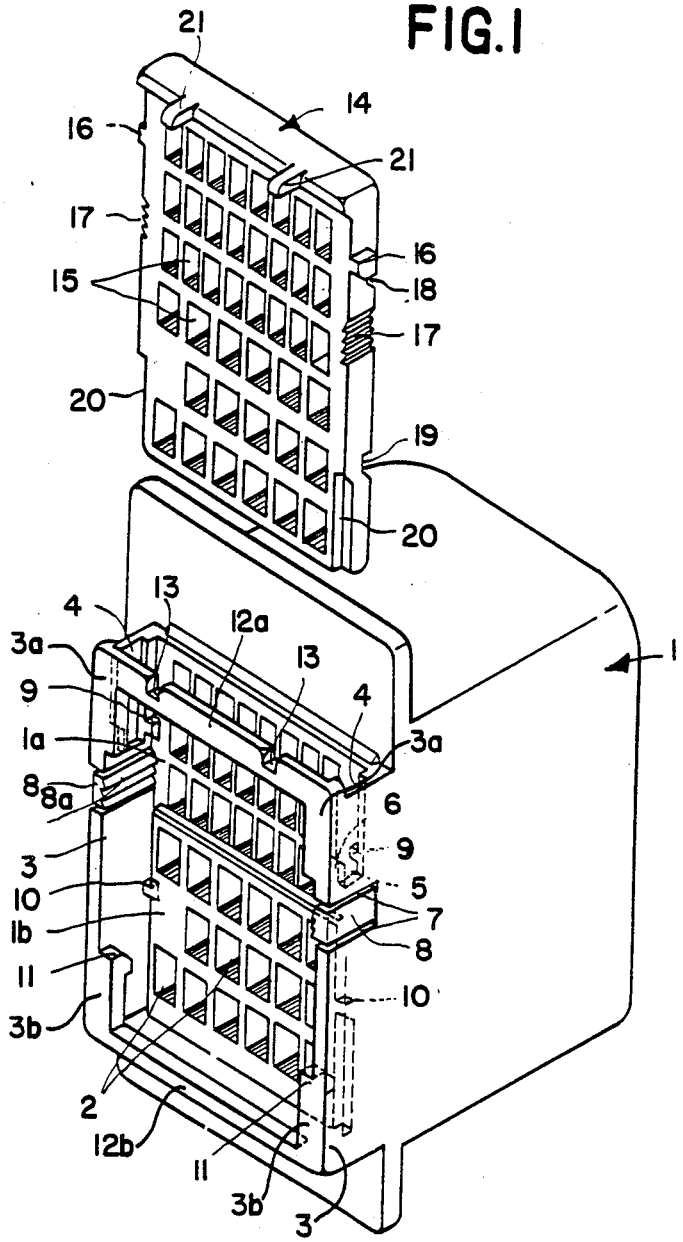
FIG. 1 is a perspective and exploded view of an electrical connector housing and latching plate as a secondary-latch member.
Figure 2:
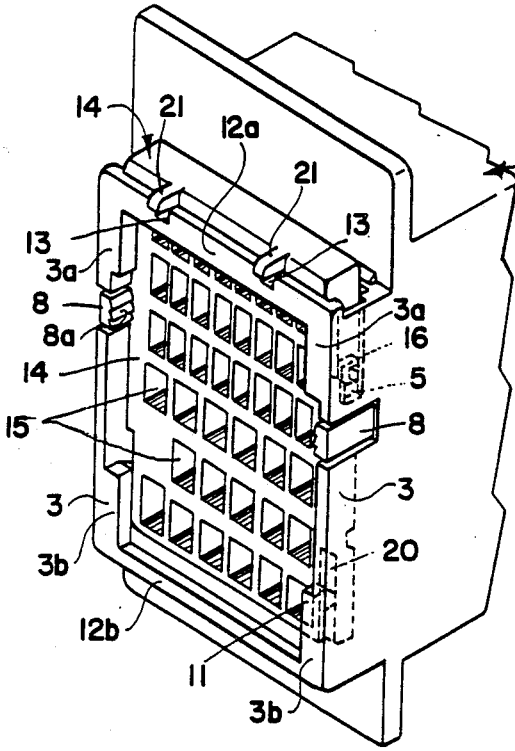
FIG. 2 is a view similar to FIG. 1 with the latching plate in a contact-insertion position at the back end of the housing to permit electrical contacts to be inserted through holes in the latching plate into contact-receiving passageways of the housing.
Figure 7:
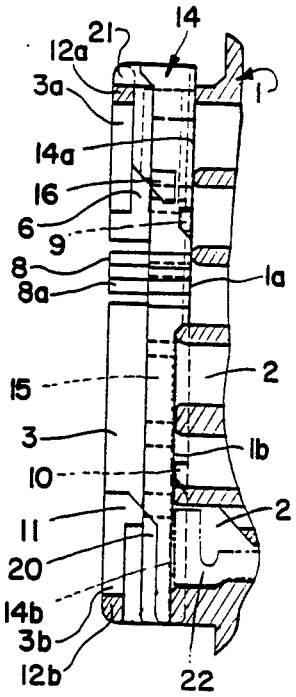

Electrical connector housing 1, as shown in FIG. 1, is molded from a suitable dielectric material and it has rows of contact-receiving passageways 2 extending therethrough. An upper section of the housing has an upper rear surface 1*a* which is spaced forwardly of lower rear surface 1*b* of a lower section of the housing thereby forming a terraced or stepped-rear surface. Side walls 3 extend rearwardly from the rear stepped surface and have grooves 4 in the upper inside surfaces so that grooves 4 oppose each other. The outer ends of side walls 3 at upper and lower parts thereof have upper and lower inwardly-directed sections 3*a* that are interconnected by an upper bar 12*a* while the bottom ends of lower sections 3*b* are interconnected by a lower bar 12*b*. Spaced recesses 13 are located in upper bar 12*a* which open upwardly. Grooves 4 have bottom narrow sections 5 that are formed by outer sides 6 as best seen in FIG. 7. The upper ends of sides 6 are tapered downwardly.

Flexible retaining members 8 are part of side walls 3 and they have ratchet teeth 8*a* on inside surfaces. Upper projections 9 extend outwardly from upper rear surface 1*a* at the bottom of grooves 4 and lower projections 10 are located in a space between side walls 3 and the side walls of the lower section just above lower inwardly-directed sections 3*b* which have projections 11 at the upper end. The outer surfaces of projections 9, 10 are in the same plane which also contains lower rear surface 1*b* and the bottom surfaces of projections 9, 10 are tapered whereas the upper surfaces of projections 11 are tapered.

Figure 3:
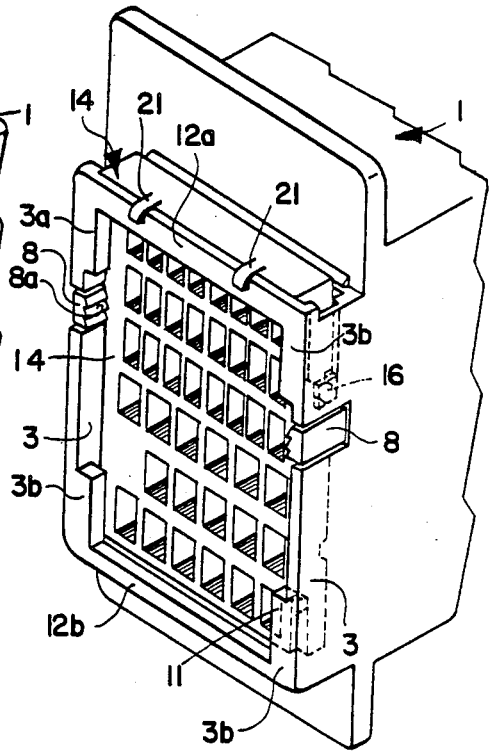
FIG. 3 is the same as FIG. 2 showing the latching plate in a contact-latching position.
Figure 5:
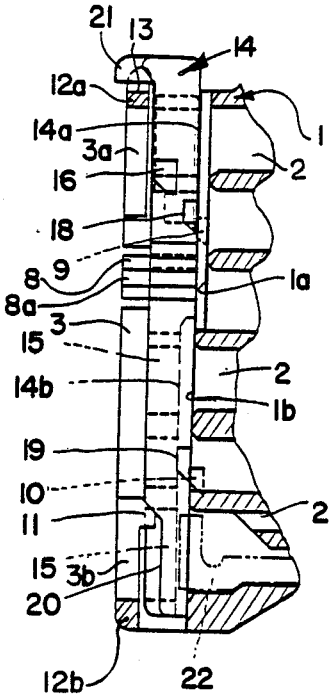
FIGS. 5, 6 and 7 are part cross-sectional views showing the operation of the latching plate.
Figure 6:
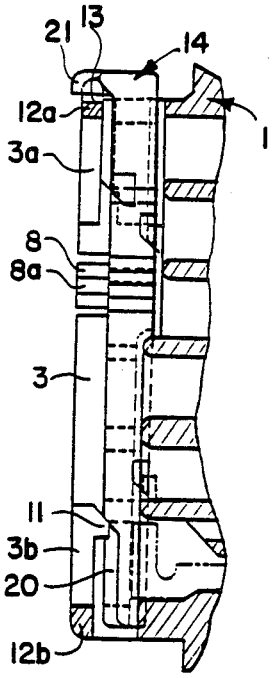

Secondary latch member 14 is a dielectric plate that is positioned within the space formed by side walls 3, bars 12*a*, 12*b* and sections 3*a*, 3*b* and is movable in a down and in direction when moved from an upper contact-insertion position to a lower contact-latch position. Latch member 14 has openings 15 that correspond to contact-receiving passageways 2 of housing 1. Projections 16 extend outwardly from the sides of member 14 above ratchet teeth 17 which are located within the sides. The bottom outer corners of projections 16 are tapered. An upper section of member 14 has an inner upper surface 14*a* and and a lower section of member 14 has an inner lower surface 14*b* spaced inwardly from upper surface 14*a* between thin extensions of the sides along the lower section of member 14. Thus, the inner surface of member 14 is a stepped surface like the stepped rear surface of the housing 1 but in a reverse direction. Inner recesses 18 are located in the sides of the upper section of member 14 between projections 16 and ratchet teeth 17 and inner recesses 19 are located in the thin extensions of the lower section of member 14. Inner upper surface 14*a* of member 14 engages the outer surfaces of projections 9 adjacent recesses 18 while the surfaces of the thin extensions of the lower section of member 14 which are in the same plane as the inner upper surface 14*a* and which contain recesses 19 engage the outer surfaces of projections 10. This arrangement maintains surfaces 14*a*, 14*b* of member 14 spaced from surfaces 1*a*, 1*b* of housing 1 when member 14 is at its upper contact-insertion position as shown in FIG. 5. Recesses 18, 19 are profiled to respectively mate with projections 9, 10 when member 14 is at its lower contact-latch position as shown in FIGS. 3 and 7. Outer recesses 20 are located in the lower section of member 14 below inner recesses 19 and the upper surfaces of recesses 20 are tapered. Projetions 21 extends outwardly from the upper end of member 14.

Figure 4:
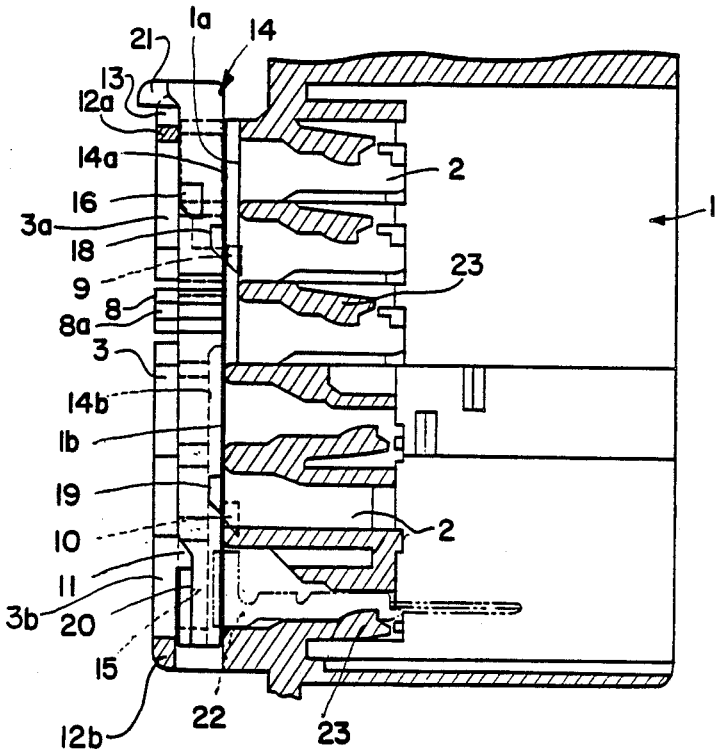
FIG. 4 is a cross-sectional view of FIG. 2.

As shown in FIG. 4, primary or housing latch members 23 are stiffly flexible members that are integral members of housing 1; they are located within contact-receiving passageways 2 and they latchably engage electrical contacts 22 when they are inserted into the passageways. Other latching arrangements can be used to latch the contacts in passageways 2 such as contact lances that engage shoulders within the passageways. Any primary latching arrangement can be used so long as it keeps the contacts from moving backward or falling out of the passageways.

Figure 8:
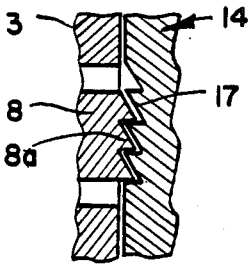
FIGS. 8A and B are part cross-sectional views showing the operation of ratchet teeth of a retaining member of the housing and ratchet teeth of the latching plate.
Figure 8:
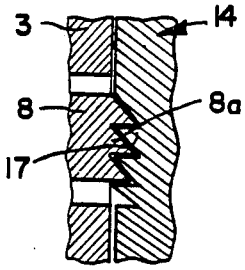

Operation of the secondary latch member 14 will now be described with reference to FIGS. 4–8. Member 14 is positioned in an upper position within the space defined by the rear stepped surface of housing 1, side walls 3, sections 3*a*, 3*b* and bars 12*a*, 12*b*. In this position, projections 16 are located in grooves 4 and its tapered corners engage the tapered surfaces of sides 6, ratchet teeth 8*a* are engaged with ratchet teeth 17 as shown in FIG. 8A, the upper tapered surfaces of projections 11 are engaged by the upper tapered surfaces of recesses 20, the outer surfaces of projections 9, 10 engage respectively inner surface 14*a* and the surfaces of the thin extensions along the sides of the bottom surface 14*b* and projections 21 are partly positioned within recesses 13. This upper position of member 14 enables contacts 22 terminated to electrical wires (not shown) to be inserted through holes 15 in member 14 and into contact-receiving passageways 2 in housing 1 with primary latch members 23 latchably engaging contacts 23 thereby latching them within passageways 2.

After contacts 23 are inserted into and latchably maintained in passageways 2, member 14 is moved downwardly which causes the tapered surfaces of sides 6 and the tapered surfaces of projections 11 to cam member 14 inwardly as it is being moved downwardly. This causes projections 16 to move into narrow bottom sections 5 of grooves 4, recesses 18, 19 to mate with projections 9, 10, the thin extensions being positoned in the spaces between the side walls 3 and the side walls of the lower housing section, ratchet teeth 17 to move along ratchet teeth 8*a* and surfaces 14*a*, 14*b* engaging surfaces 1*a*, 1*b*. In this position, the upper parts forming holes 15 in member 14 engage the rear sections of the contacts 22 preventing them from moving back. Moreover, as member 14 is being moved downwardly and inwardly, the upper parts forming holes 15 will engage any contact that is not completely inserted into its passageway and move it completely thereinto so that it and the other contacts are double latched by the primary latch members 23 and the secondary latch member 14 in housing 1. The ratchet teeth 8*a*, 17 maintain member 14 in its latched position and can only be moved upwardly by moving retaining members 8 outwardly until teeth 8*a* are free of teeth 17.

An electrical connector has been disclosed which includes primary latching members of the housing for initially latching electrical contacts in passageways of the housing and a secondary latching member that in one position permits the electrical contacts to be inserted into the passageways for latching engagement by the primary latching members and in another position the secondary latching member engages the contacts so that the primary latching members and the secondary latching member double latch the contacts in their passageways. An important feature of the secondary latching member is that it moves downwardly and inwardly from a contact-insertion position to a contact-latch positon and will move any contact completely into its passageway if it is not completely inserted therein thereby assuring that all contacts are completely inserted into and primarily latched within their passageways.

I claim:

1. An electrical connector, comprising:

a dielectric housing having contact-receiving passageways in which electrical contacts are secured therein by primary latch members;

a secondary latch member movably mounted on said housing and having holes corresponding to said contact-receiving passageways extending therethrough;

retaining means on said housing and said latch member for retaining said latch member in a contact-insertion position so that the contacts can be inserted through said holes into said contact-receiving passageways and a contact-latching position latching the contacts in the passageways; and interengaging means of said housing and said latch member to move said latch member inwardly as said latch member moves from the contact-insertion positon to the contact-latching position.

2. An electrical connector as claimed in claim 1, wherein said housing includes side walls between which the secondary latch member is movably mounted.

3. An electrical connector as claimed in claim 2, wherein said interengaging means comprise grooves on inside surfaces of said side walls which extend into narrow bottom sections with projections on the secondary latch member being disposed in and movable along the grooves and narrow bottom sections, and projections of said side walls disposed in recesses of said secondary latch member.

4. An electrical connector as claimed in claim 3, wherein the narrow bottom sections, projections and recesses have matable tapered surfaces that serve to cam the latch member inwardly during the movement of the latch member from the contact-insertion position to the contact-latching position so that the inner surface of the latch member engages the rear surface of the housing.

5. An electrical connector as claimed in claim 2, wherein the retaining means on the housing are flexible members as part of the side walls having ratchet teeth and the retaining means on the latch member are in the form of ratchet teeth engagable with the ratchet teeth of said flexible members.

6. An electrical connector as claimed in claim 4, wherein the rear and inner surfaces are stepped.

7. An electrical connector as claimed in claim 4, wherein the housing rear surfaces have upper and lower projections and the latch member has upper and lower recesses that are mated when the latch member is at the contact-latching position.

* * * * *

UNITED STATES PATENT OFFICE

CERTIFICATE OF CORRECTION

Patent No. 4,867,711 Dated September 19, 1989

Inventor(s) Katsuhiko Yuasa

It is certified that error appears in the above-identified patent and that said Letters Patent is hereby corrected as shown below:

Title page:

In the Abstract:

Line 6, the word "said" should be "side".

Line 10, add the word --be-- after the word "can".

Signed and Sealed this

Tenth Day of July, 1990

*Attest:*

HARRY F. MANBECK, JR.

*Attesting Officer*

*Commissioner of Patents and Trademarks*